United States Patent [19]

van Mullekom

[11] 4,436,122

[45] Mar. 13, 1984

[54] DEVICE FOR INSERTING A THREAD INTO THE WEAVING SHED OF A PNEUMATIC WEAVING MACHINE BY MEANS OF A FLOWING FLUID

[75] Inventor: Hubert P. van Mullekom, Deurne, Netherlands

[73] Assignee: Ruti-te Strake, B.V., Netherlands

[21] Appl. No.: 333,634

[22] Filed: Dec. 22, 1981

[30] Foreign Application Priority Data

Dec. 31, 1980 [NL] Netherlands ..... 8007127

[51] Int. Cl.[3] ..... D03D 47/30

[52] U.S. Cl. ..... 139/435

[58] Field of Search ..... 139/435; 226/97

[56] References Cited

U.S. PATENT DOCUMENTS 3,367,373 2/1968 Fransen ..... 139/435

3,999,579 12/1976 Ohkouchi et al. ..... 139/435

4,081,000 3/1978 Wollenmann ..... 139/435

FOREIGN PATENT DOCUMENTS 1261463 4/1961 France ..... 139/435

*Primary Examiner*—Henry Jaudon

*Attorney, Agent, or Firm*—Burns, Doane, Swecker & Mathis

[57] ABSTRACT

The mixing tube of the injector is narrowed at its exit end in at least one direction while retaining the cross-sectional area equal to that of the remainder of the tube. Thereby the directional stability of the thread is improved, while the friction surface presented by the tube to the thread is only slightly increased, exclusively at the tube extremity. The narrowing may be done by flattening the mixing tube end.

5 Claims, 5 Drawing Figures

DEVICE FOR INSERTING A THREAD INTO THE WEAVING SHED OF A PNEUMATIC WEAVING MACHINE BY MEANS OF A FLOWING FLUID

BACKGROUND AND SUMMARY OF THE PRESENT INVENTION

The invention relates to a device for inserting a thread into a transport tunnel formed in the weaving shed of a pneumatic weaving machine, by means of a flowing fluid, said device comprising at least one injector with a mixing tube joined with the throat thereof.

A similar device is known. The mixing tube of the injector therein generally has a circular cross-section in order to minimize the interior circumferential surface area of the mixing tube and thereby to minimize the friction losses of the transport air flowing along said surface. Generally the thread will not leave the mixing tube along the mixing tube axis but along a path deviating from the mixing tube axis. It will be clear that said deviation is smaller when the mixing tube diameter is smaller. However, in order to permit the passage of the air quantity necessary for the thread transport the mixing tube diameter has a minimum limit. This minimum determines the dispersion of the points where the thread may leave the mixing tube in order to be received in the transport tunnel.

Now for different reasons it is desirable to keep the cross-section of the transport tunnel, which e.g. is formed from the reed lamellae, as small as possible. However, the smaller the cross-section of the transport tunnel is, the greater is the possibility that the thread leaving the mixing tube is not "catched" by the entrance cross-section of the transport tunnel so that thereby the occurrence of a weaving error is induced.

The invention aims at making provisions whereby even with relatively narrow transport tunnels, a reliable transmission of the thread from the mixing tube to the transport tunnel is guaranteed. According to the invention therewith the obtained recognization is taken into account that the distance along which the thread may maximally deviate relative to the ideal path according to the mixing tube axis in a direction perpendicular to the plane of the warp threads, constitutes the critical item.

According to the invention the mixing tube is deformed at its exit end such that the exit cross-section is narrowed in at least one direction while the total cross-sectional area at this point is at least not essentially decreased relative to the remainder of the mixing tube.

In a practical embodiment of the device according to the invention the mixing tube has been flattened at the exit end along a short distance.

Through the measure according to the invention the directional stability of the thread is increased at least in one direction namely in the direction in which the mixing tube has been narrowed.

Due to the deformation or narrowing respectively, that the friction surface presented to the transport air is increased but this increase of the friction surface is very small since the deformation or narrowing respectively is limited to the extremity of the mixing tube.

The inventive measure may also be advantageously applied, for inserting the successive weft threads, more than one, e.g. two injectors are used, from which alternately one or more threads are inserted into the weaving shed, such as e.g. is described in the Dutch patent application No. 7903273. With the known construction according to the said patent application the assembly of injectors is pivotably arranged, namely such that each time one of the mixing tubes, at their exit ends situated mutually closely, enters an operative launching position relative to the entrance cross-section of the transport tunnel.

According to the invention the exit ends of the mixing tubes have been squeezed in a direction perpendicular to the line connecting the centers of the tube cross-sections.

By squeezing the exit cross-sections of the mixing tubes not only the directional stability of the threads supplied by each of the mixing tubes is improved but likewise the total exit cross-sectional area of the mixing tubes becomes situated within the influence of the entrance cross-section of the transport tunnel. Thereby when switching from one injector to another a substantially smaller angular rotation suffices and even a stationary arrangement of the injector assembly is possible which may lead to an important simplification.

In a particular embodiment according to the invention the mixing tube has been deformed at its exit end such that the exit cross-section is formed by a core cross-section having a plurality of extra versions extending therefrom in a radial direction. In this embodiment during operation a relatively large air velocity will be present in the core cross-section. The core cross-section thereby becomes a preferred area for the nesting of the thread. Thereby the directional stability of the thread leaving the mixing tube is improved not only in a direction perpendicular to the plane of the warp threads but also in the direction of the warp threads.

This embodiment is also particularly advantageous with injectors having a widening mixing tube such as described e.g. in commonly assigned copending U.S. application Ser. No. 394,936 for Method for Conveying a Flexible Thread by Means of a Pressurized Gas. For it is that in those cases the decrease of the directional stability caused by the widening of the mixing tube is compensated for by the effect of the deformation of the mixing tube exit end as applied according to the present invention.

BRIEF DESCRIPTION OF THE DRAWINGS

The invention is hereunder further illustrated with reference to the drawing showing a couple of embodiments.

DETAILED DESCRIPTION OF THE PREFERRED EMBODIMENTS

Figure 1:
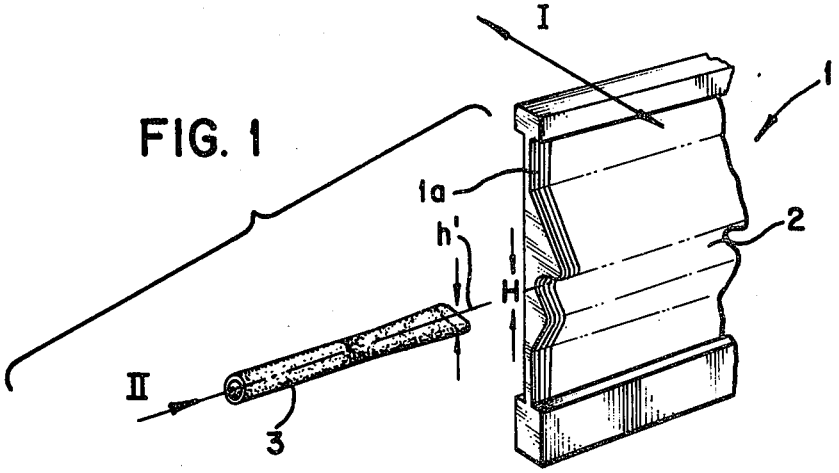
FIG. 1 is a perspective view of part of a reed delimiting a transport tunnel for weft threads and of part of the mixing tube of the device according to the invention.

The reed 1 as shown in FIG. 1 comprises in known manner contoured reed lamellae 1*a* delimiting together a transport channel or transport tunnel 2, open at one longitudinal side, for the weft threads to be inserted into the weaving shed of the weaving machine not further shown. During operation the reed is reciprocated in the direction of the arrow I. Reference number 3 indicates part of the mixing tube of a blowing nozzle or injector. The shape of the cross-section of the mixing tube portion as shown passes as seen in the thread transport direction II from a circle into a more flattened shape at the exit end of the mixing tube situated opposite to the entrance cross-section of the tunnel 2. The long axis of the exit cross-section therewith substantially coincides with the direction of movement of the reed (this is substantially parallel to the plane of the warp threads not shown in detail). The transition is such that the cross-sectional area remains, at least substantially, constant towards the exit end. In other words, the cross-sectional area of the mixing tube remains substantially constant over the length of the tube. Relative to the construction as known up till now, which has a mixing tube with a circular cross-section along its full length, the mixing tube of the device according to the invention has obtained a smaller height h' at the exit end. It will be clear that thereby the certainty that a thread leaving the mixing tube is caught within the height H of the transport tunnel 2 is essentially increased.

Figure 2:
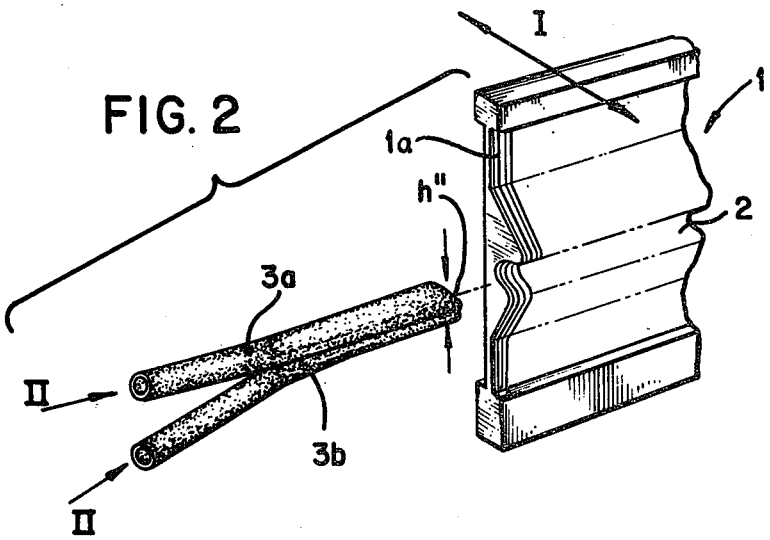
FIG. 2 is a view as shown in FIG. 1, of an embodiment having two injectors, the mixing tubes of which are joined at their exit ends.

In the embodiment according to FIG. 2 two mixing tubes 3*a* and 3*b* are applied. As shown in more detail in the patent application No. 7903273 mentioned above, alternately a plurality of threads is entered into the weaving shed of the machine, alternately by the one mixing tube 3*a* and by the other mixing tube 3*b*. The embodiment as shown in FIG. 2 differs from the known construction according to the just mentioned application in that the mixing tubes 3*a* and 3*b* being joined at their exit ends have been squeezed in the direction of the connection line of the centers of the axes of both tubes and have been widened correspondingly in the direction perpendicular thereto. With this arrangement, the total height h" has been essentially decreased relative to that of the known construction. This decrease is even such that the height h" of the total mixing tube cross-section has been moved to within the height H of the transport tunnel 2. This arrangement offers the possibility of a stationary arrangement of the mixing tube assembly as different from the known construction, which means a considerable simplification. The mounting of the mixing tube may be similar to that described in U.S. Pat. No. 4,326,565, issued Apr. 27, 1982 to Van Mullekom in which the mixing tube is movably mounted on the reed baulk to move with the reed. The tube may also be fixedly attached to the baulk or frame when a single injector is utilized.

Figure 3:
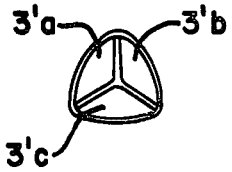
FIG. 3 is a cross-sectional view adjacent to the exit end of the mixing tubes of three cooperating injectors and FIGS. 4*a* and 4*b* are views of two modifications of the mixing tube embodiment according to FIG. 1.

FIG. 3 shows that a similar concentration of the total mixing tube cross-sections may be obtained when applying three mixing tubes.

Figure 4A:
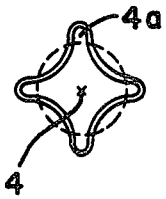
Figure 4B:
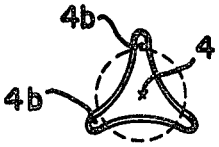

Finally FIGS. 4*a* and 4*b* show two examples of a exit cross-section for a mixing tube which is composed of a core cross-section 4 with four appendages 4*a* and 4*b* extending in radial direction therefrom respectively. The circumference of the undeformed part of the mixing tube has been indicated by broken lines.

The principles, preferred embodiments and mode of operation of the present invention have been described in the foregoing specification. However, the invention which is intended to be protected is not to be construed as limited to the particular embodiments disclosed. The embodiments are to be regarded as illustrative rather than restrictive. Variations and changes may be made by others without departing from the spirit of the present invention. Accordingly, it is expressly intended that all such variations and changes which fall within the spirit and scope of the present invention as defined in the claims be embraced thereby.

What is claimed is:

1. A device for inserting a thread into a transport tunnel formed in the weaving shed of a pneumatic weaving machine, the thread being inserted by a flowing fluid, said device comprising at least one injector including a unitary mixing tube through which the thread passes, the mixing tube being deformed at an exit end such that the exit cross-section is non-circular and is narrowed in at least one direction, the upstream portion of the mixing tube being substantially circular, the total cross-sectional area at the exit end being substantially that of the remainder of the mixing tube.

2. Device according to claim 1, wherein the mixing tube has been flattened along a short distance at the exit end.

3. Device according to claim 1, further comprising a plurality of injectors from which alternately one or more threads are inserted into the weaving shed, the exit ends of the mixing tubes having been squeezed along a connection line of the centers of the tube cross-sections.

4. Device according to claim 1, wherein the mixing tube is deformed at the exit end such that the exit cross-section has a core cross-section having a plurality of appendages extending in a radial direction therefrom.

5. Device according to claim 2, further comprising a plurality of injectors from which alternately one or more threads are inserted into the weaving shed, the exit ends of the mixing tubes having been squeezed along a connection line of the centers of the tube cross-sections.

* * * * *